United States Patent [19]

Harvey, Sr.

[11] Patent Number: 4,969,570

[45] Date of Patent: Nov. 13, 1990

[54] PROTECTIVE RING FOR USE ON OPEN FRICTION LID CONTAINERS

[76] Inventor: Billy W. Harvey, Sr., 49 Valley Dr., Princeton, W. Va. 24740

[21] Appl. No.: 467,530

[22] Filed: Jan. 19, 1990

[51] Int. Cl.[5] ..... B65D 25/00

[52] U.S. Cl. ..... 220/90

[58] Field of Search ..... 220/85 R, 90, 266, 270

[56] References Cited

U.S. PATENT DOCUMENTS

| | | | |
|---|---|---|---|
| 2,873,881 | 2/1959 | Nichols | 220/90 |
| 2,903,154 | 9/1959 | Hendershot | 220/90 |
| 2,960,257 | 11/1960 | Sasse | 220/90 |
| 3,016,169 | 1/1962 | Kirshenbaum | 220/90 X |
| 3,469,735 | 9/1969 | Burt | 220/90 |
| 3,693,829 | 9/1972 | Price | 220/90 |
| 3,894,650 | 7/1975 | Crump | 220/90 |
| 4,203,537 | 5/1980 | McAlister | 220/90 X |
| 4,225,064 | 9/1980 | Westcott | 220/90 X |
| 4,240,568 | 12/1980 | Pool | 220/90 X |
| 4,312,459 | 1/1982 | Leach | 220/90 X |

*Primary Examiner*—Steven M. Pollard

*Attorney, Agent, or Firm*—Mason, Fenwick & Lawrence

[57] ABSTRACT

A protective thing for friction-fit container closures is disclosed, comprising a disposable annular ring provided with an annular bead about its lower surface for insertion into the sealing groove on a container lip and which ring has inner and outer circumferential downward facing flanges, a pull tab on the outer circumferential downward facing flanges to facilitate easy removal, and an inward pitch built into the annular ring to encourage the return of material into the container rather than onto the outer sides of the container. In one embodiment of the invention, a protective ring cover is provided having a pull tab on its outer circumference proximate to a tear line, which tear line facilitates easy removal of the ring cover, by permitting the cover to be quickly torn along the tear line and upwardly lifted from the container. In such an embodiment incorporating a tear line, the protective ring cover is fabricated of stiff coated paper or other suitable disposable material. In an alternative embodiment, the protective ring cover according to the present invention is provided without a tear line, and is molded of resilient plastic so that the cover may be re-used.

7 Claims, 1 Drawing Sheet

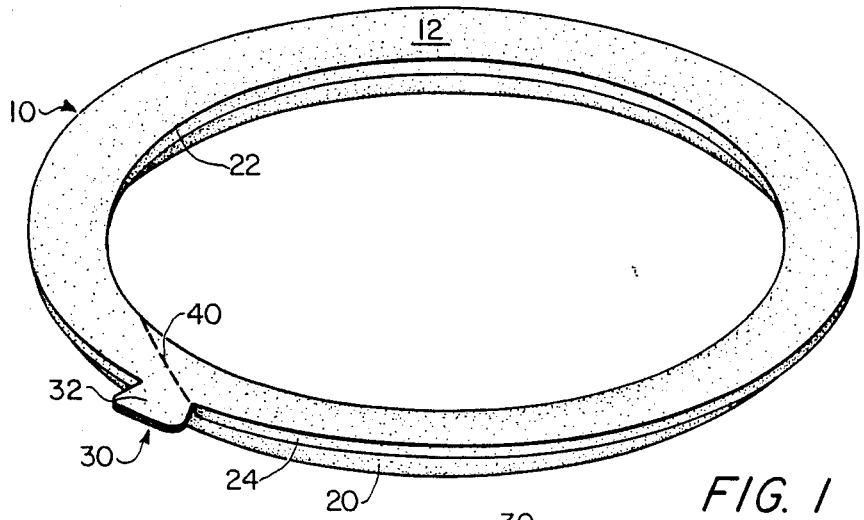
FIG. 1
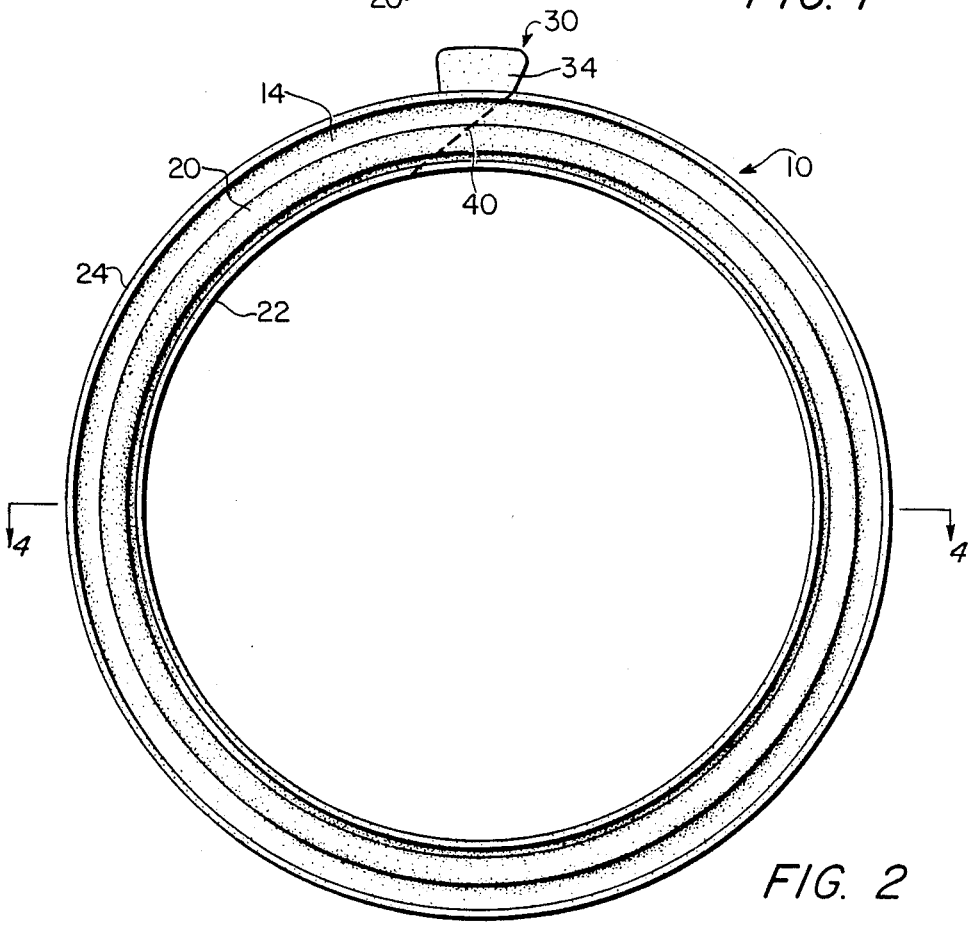
FIG. 2
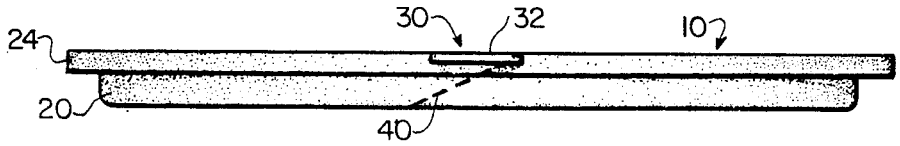
FIG. 3
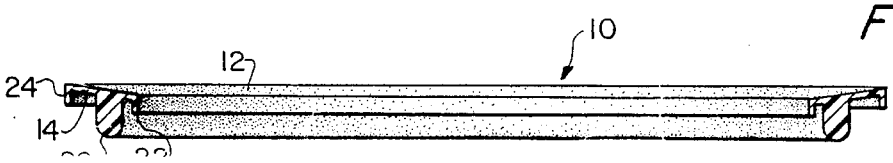

PROTECTIVE RING FOR USE ON OPEN FRICTION LID CONTAINERS

BACKGROUND OF THE INVENTION

The present invention generally relates to apparatus for covering and protecting open containers having friction-fit lids, such as paint cans, glue cans, and the like. The present invention specifically relates to protective rings which protect, and prevent fouling of open containers having friction-fit lids.

FIELD OF THE INVENTION

Many types of coatings and adhesives, primarily paints, are packaged in cans of various sizes having friction seal lids. Friction lids provide a reliable, safe, and secure means for resealing the container to preserve the unused contents. The coatings stored in friction-lid containers require a tight, positive seal, since the coatings will solidify and become useless if exposed to air for an extended period of time. Unfortunately, it may be difficult to reseal a friction-lid container after using some of the contents, because the contents accumulates in the groove into which the lid must be pressed for resealing. This fouling of the groove occurs because most consumers use the original container as a supply can while using or applying the product. Consequently, in the process of pouring from the container or placing brushes or other tools into the can, the sealing groove of the friction-lid becomes coated or filled with product.

To properly reseal the container, the coated groove must be wiped clean. This wiping task is difficult and messy, and, is rarely performed well by consumers. The task is made more difficult because the products commonly stored in friction-lid cans, including paints, adhesives, fillers, sealers, mastic, etc., are intended to adhere tightly to a surface to which they are applied; consequently, they also adhere tightly to the sealing groove of the container.

In the prior art, attempts to remedy this shortcoming of the friction lid are manifested in several devices designed to prevent fouling of the lid and also provide other uses. For example, U.S. Pat. No. 3,913,785 (Pattershall) provides a stacking aid and cover for a paint can. Similarly, U.S. Pat. No. 2,960,257 (Sasse) discloses a brush drip bar incorporated into a pouring spout which can be attached to an open friction-lid container. Recent trade publications have included advertisements for a "Clip Top Paint Can Lid" having a covered slot for a paint brush, and a "Neat Painter" having a brush holder and pouring spout. However, these devices are large, cumbersome, relatively expensive, and do not provide a simple and efficient method of preventing fouling of an open frictionlid container.

Other prior art devices have similar disadvantages. For example, U.S. Pat. No. 4,369,890 (Bennett) discloses a paint can collar having a lower lip portion 12 designed to fit the inner rim of a paint can lip, an intermediate annular ring portion 14 extending from the lower lip portion 12 intended to rest upon and cover a paint can's grooved lip, and an upper lip portion 16 of frustoconical shape extending from the intermediate annular ring 14 outward beyond the top of the paint can. Due to the frustoconical upper lip portion 16, it is necessary to align a pair of bi-symmetrical indentations 18 with the paint can handle so that the container may be carried without removing the paint can collar.

U.S. Pat. No. 4,312,459 (Leach) discloses a paint can rim cover and lid combination. The rim cover 30 is an annular ring made of a flexible material such as molded plastic, which has a wide inner flange 35 and a wider outer flange 36 which depend from base 37 (see FIGS. 3 and 4). Lips 42 and 43 on the inner sides of flanges 35 and 36 are provided to grip beads 16 and 17 on the paint can rim when the rim cover 30 is installed. A protruding bead 60 extends around the outer circular flange 36 to engage the inner peripheral flange 51 of lid 31. This invention is relatively expensive and may itself become fouled with paint or adhesive.

U.S. Pat. No. 4,240,568 (Pool) discloses an attachment for liquid carrying containers which combines a body piece 20 and a lid closure member 21. Body member 20, best seen in FIGS. 1–3, has an annular ledge 22 with an inner peripheral edge 23, an outer peripheral edge 24, top surface 25, bottom surface 27, and a rim 28 extending upwardly from the top surface 25 at outer peripheral edge 24. Ledge 22 covers gutter 72 on the inward facing lip of a standard paint can to prevent the accumulation of liquid therein. Rim 28, which extends upwardly from the top surface 25, helps to direct liquid onto ledge 22 and subsequently back into the container. An annular bead 90 is sized to be slightly compressed during insertion into the gutter 72 so that it assists the lip cover onto the can while preventing the accumulation of liquid within the gutter 72.

U.S. Pat. No. 4,020,968 (Chiavola et al) discloses a device to extend and guard container rims. An annular flange 2 has a tubular member 1 integrally attached to the interior circumference. Annular flange 2 extends radially and horizontally from the lower end 3 of tubular member 1 so that it completely surrounds grooved rim 4 on container 5. Internal member 6 extends downwardly from tubular member 1 which protrudes into container 5. Annular flange 2 forms a horizontal; bridge member 10 between the vertical internal member 6 and the vertical external member 7; these parts are shaped to resiliently and firmly engage rims of containers which may deviate in size or shape from that of standardized containers. Internal member 6 is tapered to form an angle between bridge member 10 and internal member 6. This helps to firmly engage the inner edge of the rim of a container at any point along the tapered and internal member 6.

U.S. Pat. No. 3,727,792 (Levin) discloses an attachment for the rim of paint cans which is formed from a plurality of annular ring members with rings of lesser diameter formed to the inner circumference of the outer rings. The rings are readily detachable from each other for independent use on cans of different diameter. Inclined outer annular wall 48 cooperates with vertical inner wall 44 to "snap over" a container lip. A ridge 54 has been provided on top wall 42 to serve as a surface for scraping excess paint off of brushes while allowing it to flow back into the container.

U.S. Pat. No. 3,693,829 (Price) discloses a protective apron for containers formed by a horizontal annular ring 16 joined on its inner circumference by a vertical flange 17 which extends downward into the central opening of a container. A conically-shaped external portion 15 meets the outer circumference of annular ring 16, slopes downwardly away from the container side 10, and terminates at upwardly sloping annular ring 14. The junction of horizontal annular ring 16 with the top of cone 15 forms a ledge upon which paint or other liquid may collect. In addition, the junction between the bottom of conically-shaped external portion 15 with upwardly sloping flange 14 provides a gutter for collection of excess paint or other material.

U.S. Pat. No. 3,326,409 (Speer) discloses a drip-proof paint can insert which prevents fouling of grooved can lips. Annular ring 30 has a tapered wall 39 along its inner circumference to provide for the insertion of a disposable funnel insert. The disposable funnel insert enables drops of paint to run back into the paint can through integral neck 36 inserted therein.

The prior art patents of Price, Speer, Levin, Chiavola et al, Pool, Leach and Bennett all disclose a cover which prevents fouling of a grove in an inward facing container lip. The devices shown in these patents are large, cumbersome and expensive, and do not disclose a protective ring for the lip of fiction-lid containers which includes all of the features of the present invention. Specifically, Price's conically-shaped downwardly sloping external portion 15 does not assist in gripping the outer circumference of the container lip and requires an additional flange 18.

Further, none of the prior art patents show a disposable protective ring cover for friction lid containers having an annular bead on its lower surface which simultaneously secures the cover to the friction lid container and fills the channel of the friction lid container to prevent fouling of the can and which patents provide a gripping tab to facilitate quick removal and disposal of the protective cover ring. Thus, the prior art is deficient in showing a unitary device which performs all of the functions of the present invention with the simplicity of the present invention.

Therefore, many consumers would find it desirable to have a protective cover ring for friction lid containers which is inexpensive, quick and easy to remove and dispose, simple, and effective.

SUMMARY OF THE PRESENT INVENTION

Accordingly, it is one object of the present invention to provide a disposable protective container ring cover having an annular bead molded into its lower surface, which bead simultaneously facilitates securing the invention to the friction lid container, and provides means for completely filling the channel of a friction lid container to prevent fouling thereof.

It is yet another object of the present invention to provide a protective ring cover having a gripping tab which reduces the amount of material required to mold the ring cover, which tab simultaneously facilitates easy and quick removal and disposal of the protective ring cover.

It is yet a further object of the present invention to provide a protective ring cover for friction lid containers which is inexpensive, disposable, simple and efficient to operate.

The foregoing objects of the invention, and other objects, are achieved through a disposable annular ring provided with an annular bead about its lower surface for insertion into the sealing groove on a container lip and which ring has inner and outer circumferential downward facing flanges, a pull tab on the outer circumferential downward facing flanges to facilitate easy removal, and an inward pitch built into the annular ring to encourage the return of material into the container rather than onto the outer sides of the container.

In one embodiment of the invention, a protective ring cover is provided having a pull tab on its outer circumference proximate to a tear line, which tear line facilitates easy removal of the ring cover, by permitting the cover to be quickly torn along the tear line and upwardly lifted from the container. In such an embodiment incorporating a tear line, the protective ring cover is fabricated of stiff coated paper or other suitable disposable material. In an alternative embodiment, the protective ring cover according to the present invention is provided without a tear line, and is molded of resilient plastic so that the cover may be re-used.

BRIEF DESCRIPTION OF THE DRAWINGS

FIG. 1 is a top perspective view of a protective ring cover according to the present invention.

FIG. 2 is a bottom plan view of a protective ring cover according to the present invention.

FIG. 3 is a front side elevation view of the present invention.

FIG. 4 is a front side sectional view of the present invention taken along line 4—4 of FIG. 2.

DETAILED DESCRIPTION OF THE PREFERRED EMBODIMENTS

In describing the preferred embodiments of the subject invention illustrated in the drawings, specific terminology will be used for the sake of clarity. However, the invention is not intended to be limited to the specific terms so selected, and each specific term includes all technical equivalents which operate in a similar manner to accomplish a similar purpose.

Referring generally to the preferred embodiment illustrated in FIGS. 1–4, and referring specifically to FIG. 1, a protective ring cover for friction lid containers according to the present invention is generally referred to with reference numeral 10, and includes a relatively smooth inwardly inclined circular circumferential top surface 12 and an upwardly slanted circular circumferential bottom surface 14. The surface 12 is sloped inwardly at an angle of approximately 8° to facilitate drainage of paint or other coating into the container when the protective ring cover is placed upon the can.

The ring 10 includes an annular bead 20 fabricated in a generally circular shape and secured to the bottom surface 14 of the ring 10. As is shown in the section view, FIG. 4, the bead 20 conforms to the section profile of a friction lid container groove such as that provided on a paint can. When the present invention is placed upon the closure of a paint can, the annular bead 20 is inserted into the sealing groove on the friction lid container and completely fills the groove, thereby preventing fouling of said groove.

Referring now to FIGS. 2 and 4, the ring 10 is provided with an inner circumferential downward facing flange 22 and an outer circumferential downward facing flange 24. When the ring according to the present invention is placed upon the closure of a friction lid container, the flange 24 extends over and; exerts a friction grip upon the outer surface of a friction lid container body. Similarly, the inner circumferentially flange 22 presses against and forms a seal with, using friction lid pressure, the inner circumferential surface of a container friction lid closure.

In this manner, a ring cover according to the present invention is pressed into and fully covers and seals the friction lid groove of a conventional friction lid container, thereby preventing any material from entering the groove and fouling it.

Referring now to FIGS. 1 and 2, a ring 10 according to the present invention is provided with a pull tab 30 secured to its outer circumference; the pull tab 30 is thinner than the ring 10 and has a top surface 32 and a similarly smooth bottom surface 34 which surfaces 32 and 34 act as finger grips for the tab 30.

In one embodiment of the present invention, in which the ring cover 10 is fabricated of a non-disposable material such as plastic, the ring 10 may quickly be removed from a friction lid container by pulling the tab 30 in a direction perpendicular to a radius of the ring 10. Thus, by pulling the tab 30 towards the center of the ring 10, the ring 10 will flex and easily dislodge from the container.

The pull tab 30 represents a significant advantage over the prior art, because it enables a ring 10 according to the present invention to be constructed with a relatively small outer diameter, since the ring 10 need not include gripping space around its entire circumference to facilitate removal from the can. The existence of the tab 30 provides gripping space, and entirely precludes the need to provide gripping space around the entire circumference of the invention.

In an alternative embodiment, an angled tear line or laceration 40 is provided proximate to the tab 30. The tear line 40 preferably comprises a plurality of perforations linearly arranged at an acute angle with respect to a tangent of ring 10. In such an alternative embodiment, a ring according to the present invention is fabricated of a relatively easily torn material such as pressed, coated paper, and the ring 10 may easily be removed from a friction lid container by grasping the tab 30 and pulling it along the tear line 40. Force exerted along the perforated tear line 40 will cause the ring 10 to tear along the line 40, thereby facilitating removal of the ring from the can.

Provision of the tab 30 permits the ring 10 to be substantially smaller in overall dimensions than protective ring covers of the prior art. Specifically, provision of a tab 30 for gripping the ring 10 before removing the ring 10 from a friction lid container, provides sufficient grasping area to facilitate easy removal of the ring 10. In the prior art, cover rings and protective lids for friction lid containers have been made with large overall dimensions to permit grasping the ring and removing it from the container. However, provision of a pull tab 30 secured to the ring 10 according to the present invention, provides gripping space sufficient to facilitate rapid removal of the ring 10 from a friction lid container.

Many modifications and variations of the present invention are possible in light of the above teachings and specification. It is therefore to be understood that, within the scope of the appended claims, the invention may be practiced otherwise than as specifically described.

What is claimed is:

1. A ring cover for open friction lid containers, said containers having a closure including a circular groove for receiving a friction lid, an inner circumferential surface, and an outer circumferential surface;

said cover comprising:

annular ring means for covering said groove end for preventing entry of foreign mater into said groove;

groove securement means for securing said cover within said groove and for retaining said cover within said groove;

first circular circumferential flange means for securing said cover to said closure inner circumferential surface;

second circular circumferential flange means for securing said cover to said closure outer circumferential surface; and removal means secured to said second flange for facilitating removal of said cover from said groove;

said annular ring means including a laceration on said annular ring means.

2. The ring cover of claim 1, said annular ring means comprising an annular ring having a top face;

an inner circumferential surface, an outer circumferential surface, and a bottom face, wherein said surface laceration traverses said top face.

3. The cover of claim 2, said removal means comprising a pull tab secured to said second flange adjacent said laceration.

4. A ring cover for open friction lid containers, said containers having a closure including a circular groove for receiving a friction lid, an inner circumferential surface, and an outer circumferential surface;

said cover comprising:

annular ring means for covering said groove and for preventing entry of foreign matter into said groove;

groove securement means for securing said cover within said groove and for retaining said cover within said groove;

first circular circumferential flange means for securing said cover to said closure inner circumferential surface;

second circular circumferential flange means for securing said cover to said closure outer circumferential surface; and removal means secured to said second flange for facilitating removal of said cover from said groove;

said annular ring means comprising an annular ring having a top face, an imner circumferential surface, an outer circumferential surface, and a bottom face;

said groove securement means comprising a downwardly projecting annular bead secured to said bottom face;

a first circular circumferential downward facing flange having a first top surface secured to said inner circumferential surface; and a second circular circumferential downward facing flange having a second top surface secured to said outer circumferential surface;

said removal means comprising a pull tab secured to said second flange;

said removal means comprising a pull tab secured to said second flange; and tear line means disposed proximate to said pull tab for facilitating tearing of said cover and removal from said closure.

5. The cover of claim 4, said tear line means comprising a plurality of perforations in said ring, said perforations arranged linearly and disposed at an acute angle relative to a tangent of said first circumferential surface.

6. A ring cover for open friction lid containers comprising:

an annular ring having a top face, an inner circumferential surface, an outer circumferential surface, and a bottom face;

a downwardly projecting annular bead secured to said bottom face;

a first circular circumferential downward facing flange having a first top surface secured to said inner circumferential surface;

a second circular circumferential downward facing flange having a second top surface secured to said outer circumferential surface;

a pull tab secured to said second flange;

and tear line means disposed proximate to said pull tab for facilitating tearing of said ring and removal thereof from said friction lid container.

7. The cover of claim 6, said tear line means comprising a plurality of perforations in said ring, said perforations arranged linearly and disposed at an acute angle relative to a tangent of said first circumferential surface.

* * * * *